US005530199A

United States Patent [19]

Blucher

[11] Patent Number: 5,530,199

[45] Date of Patent: Jun. 25, 1996

[54] ELECTROMAGNETIC PICKUP FOR STRINGED MUSICAL INSTRUMENTS

[75] Inventor: Steven L. Blucher, Staten Island, N.Y.

[73] Assignee: DiMarzio Inc., Staten Island, N.Y.

[21] Appl. No.: 517,749

[22] Filed: Aug. 22, 1995

[51] Int. Cl.[6] ..... G10H 3/18

[52] U.S. Cl. ..... 84/728

[58] Field of Search ..... 84/725, 726, 727, 84/728

[56] References Cited

U.S. PATENT DOCUMENTS

| | | | |
|---|---|---|---|
| 2,896,491 | 7/1959 | Lover . | |
| 3,588,311 | 6/1971 | Zoller . | |
| 4,372,186 | 2/1983 | Aaroe . | |
| 4,501,185 | 2/1985 | Blucher | 84/728 |
| 4,581,974 | 4/1986 | Fender | 84/725 |
| 4,581,975 | 4/1986 | Fender | 84/725 |
| 5,111,728 | 5/1992 | Blucher et al. . | |
| 5,399,802 | 3/1995 | Blucher . | |

*Primary Examiner*—William M. Shoop, Jr.
*Assistant Examiner*—Marlon T. Fletcher
*Attorney, Agent, or Firm*—Brumbaugh, Graves, Donohue & Raymond

[57] ABSTRACT

An electromagnetic pickup for stringed musical instruments has a primary bobbin having an elongated body with holes for receiving at least one pole piece or magnet and a coil of wire wrapped around the elongated body. At least one magnet is positioned in close proximity to the primary bobbin to create a magnetic field around the primary bobbin. In addition, the pickup includes a secondary bobbin having a body significantly smaller than that of the primary bobbin; a coil of wire is wrapped around the smaller body. The secondary, or hum-cancelling, bobbin is positioned in close proximity to the primary bobbin solely to cancel an audible hum caused by a power supply used in the amplification equipment and/or other environmental sources.

9 Claims, 1 Drawing Sheet

ELECTROMAGNETIC PICKUP FOR STRINGED MUSICAL INSTRUMENTS

This invention relates to transducers, or electromagnetic pickups, for musical instruments and more particularly, to pickups for electrical string instruments which provide a truer, more pleasing tonal quality at a lower cost of manufacture.

BACKGROUND OF THE INVENTION

As described in one of the inventor's patents, U.S. Pat. No. 4,501,185, electromagnetic pickups are used with stringed musical instruments, such as electric guitars, to convert the vibrations of "picked" strings into electrical signals for subsequent amplification into sound. The pickups usually comprise a magnet system, including one or more permanent magnet elements and pole pieces, to establish a magnetic field within which the strings vibrate, and coils wound on bobbins disposed in the field to generate electrical signals corresponding to flux variations in the field due to the strings' vibrations. These electrical signals are amplified into musical sounds by circuits and equipment well-known in the trade.

Typically, the pole pieces of a pickup are situated through the bobbins and the pickup itself is generally mounted on the face of the instrument below the strings. The coils for developing the electrical signals are wound on bobbins arranged so that the pole pieces are within the coils to allow the magnetic field developed by the magnet and pole pieces to envelope the coil. Each string, when set into motion, causes variations in the magnetic field in the vicinity of the pole piece or pieces and the variations are converted into electrical signals by the interaction of the magnetic field with the coil.

One particular type of an electromagnetic pickup is the single-coil arrangement. As the instrument's strings vibrate, the single coil senses the magnetic field variations and converts those variations to electrical signals. This type of pickup has a disadvantage in that an audible hum is created when the coil senses interference caused by radiating electromagnetic generating sources. For example, the single coil tends to pick up 60 cycle signals emanating from the power supply used in the amplification equipment as well as from other environmental sources. The 60 cycle signal is converted into a hum which is amplified, thereby distorting and degrading the quality of the musical sound.

The dual-coil, or "humbucking," pickup was developed to address this problem. One known arrangement is illustrated in U.S. Pat. No. 2,896,491, granted Jul. 28, 1959 to Lover. In the dual-coil arrangement, two coils are disposed adjacent to each other out of phase such that the 60 cycle currents produced in the coils by the interfering sources cancel one another out. This may be accomplished through reversing the winding direction of the second coil, or more usually accomplished with the two coils wound in the same direction, but connected out of phase. As a result, the audible hum is eliminated. However, this arrangement has two disadvantages of its own.

First, the introduction of a second coil increases the overall resistance, impedance, and inductance of the pickup. This results in a lower sensitivity to the vibrations of the strings and a weaker signal due to the loss of higher frequencies. Second, the dual-coil arrangement senses vibrations of each string at two relatively widely spaced points along the string, causing unnatural reinforcement and cancellation of certain harmonic frequencies other than the 60 cycle hum frequency generated by the vibrating strings. As a result, musical sound quality is degraded.

A number of solutions have been suggested for eliminating the second problem. These have included mounting the coils one on top of the other, using different diameter or gauge wire on each coil, and constructing the pickup so that the pole pieces are vertically offset. These methods, while addressing the frequency cancellation and reinforcement problem to differing degrees, do not affect the problem of additional resistance, impedance, and inductance introduced by the second coil. It is a primary objective of the present invention to provide an electromagnetic pickup that solves both problems.

SUMMARY OF THE INVENTION

The present invention overcomes the prior art limitations by providing a primary coil for sensing changes in a magnetic field due to the vibration of strings and converting the string vibrations to electrical signals, and a secondary coil, significantly smaller in dimension, solely for cancelling the hum induced by interfering electromagnetic fields. It has been found that this arrangement has the advantage of producing a higher fidelity sound due to the absence of phase cancellation and frequency reinforcement normally created when two coils are used to sense vibrating strings at different points along the strings. By employing a relatively small secondary coil which does not serve as a transducer but instead solely cancels hum, the pickup will have a significantly lower resistance, impedance and inductance than a standard two coil arrangement, thereby allowing greater reproduction of higher frequencies with less degradation of tone. Finally, pickups according to the present invention can be manufactured at a significantly lower cost than conventional dual-coil pickups.

BRIEF DESCRIPTION OF THE DRAWING

Further objects, features and advantages of the invention will become apparent from the following detailed description taken in conjunction with the accompanying figures in which.

Figure 1:
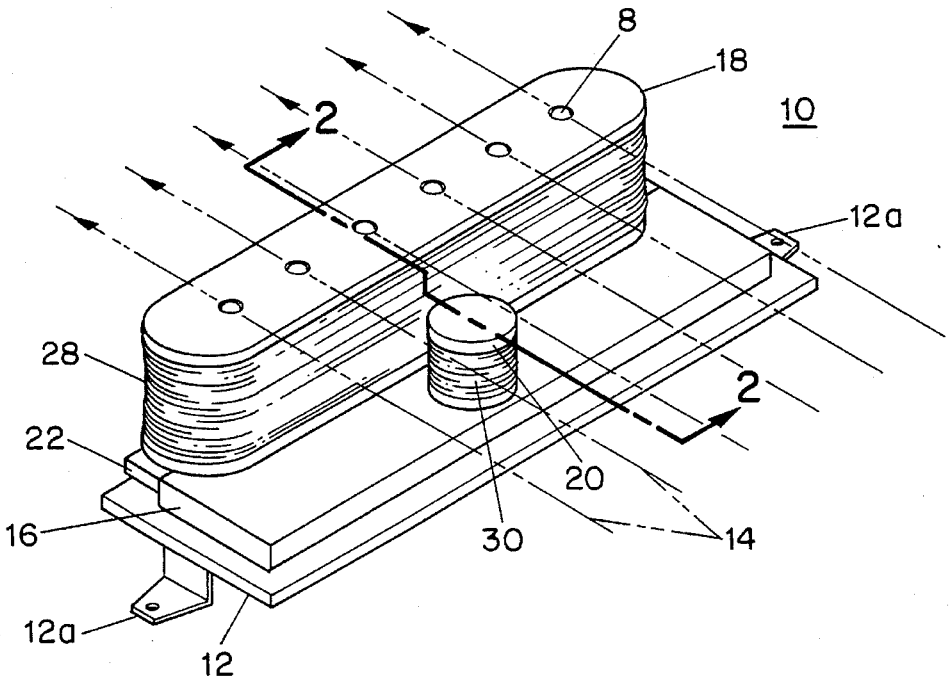
FIG. 1 is a perspective view of a pickup in accordance with a preferred embodiment of the invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

Figure 2:
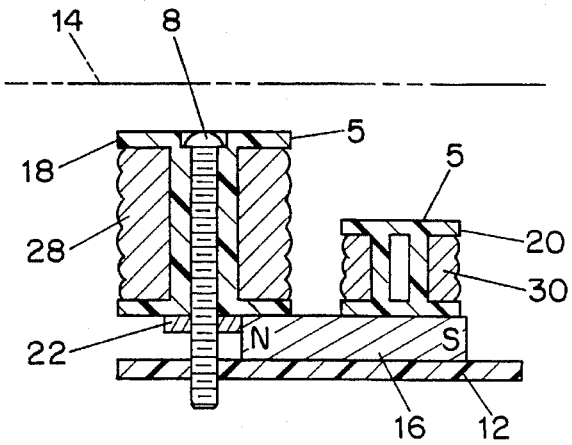
FIG. 2 is a cross-sectional view of the pickup taken along the lines 2—2 of FIG. 1.

FIGS. 1 and 2 illustrate a preferred embodiment of the present invention. Pickup 10 includes base plate 12 consisting of a rigid, non-magnetic material suitable for mounting to the face of a stringed musical instrument such as an electric guitar (not shown), To enable mounting, base plate 12 includes mounting foot 12*a* at each of the plate's two ends. The strings 14 of the instrument are shown schematically by dashed lines. Permanent magnet 16, having one longitudinal edge portion constituting a magnetic north pole and an opposing longitudinal edge portion constituting a magnetic south pole (as designated in FIG. 2), is positioned on base plate 12. Alternately, more than one magnet may be used to create the magnetic field. Magnet 16 is generally about as long as base plate 12 and may be positioned along a metallic strip 22 which preferably bears against the magnetic north pole of magnet 16 or in close proximity to it. Metallic strip 22 is of appropriate magnetizable material and its length is, preferably, about the same as that of magnet 16. Thus, strip 22 constitutes a magnetic north pole.

Strip 22 has holes so that threaded pole pieces 8 may pass therethrough. Pole pieces 8 are made of metallic and magnetizable material and are conveniently placed or threaded into corresponding holes in base plate 12. Pole pieces 8 are positioned below the strings 14 of the musical instrument and may be individually adjusted (by threading more or less into the base plate) to vary the spacing between pole pieces 8 and strings 14. Preferably, a primary bobbin 18 is positioned over strip 22 such that the pole pieces 8 pass through holes in the primary bobbin 18 before entering holes in strip 22 and base plate 12.

In accordance with the invention, a secondary bobbin 20 is provided significantly smaller in dimension than primary bobbin 18. This secondary bobbin 20 is employed solely for cancelling the hum induced by interfering electromagnetic fields. It does not serve as a transducer (like primary bobbin 18) and preferably plays no role in establishing a magnetic field. As a result, secondary bobbin 20 may have a hollow core or, alternately, a ferromagnetic core to increase its inductance, if desired, and provide better hum cancellation.

Secondary bobbin 20 is positioned in relation to primary bobbin 18 to provide the greatest hum cancellation, and preferably, as close to primary bobbin 18 as possible. Specifically, secondary bobbin 20 should be situated directly adjacent to and on a parallel plane with primary bobbin 18 as shown in FIGS. 1 and 2. Secondary bobbin 20 may sit directly on magnet 16 to which it preferably is attached by an adhesive. Other methods of attachment, of course, are acceptable.

Primary bobbin 18 and secondary bobbin 20 each have a body 5 made of non-electrically conductive, non-magnetic and non-magnetizable material. Coils 28 and 30 are wound about body 5 of primary bobbin 18 and secondary bobbin 20, respectively. The coils may be formed of 5,000 turns of 42 gauge insulated copper wire, of 10,000 turns of 50 gauge wire, or of some other combination known to those in the art. The coils also may use different gauges of wire, as disclosed in the inventor's U.S. Pat. No. 4,501,185.

Figure 3:
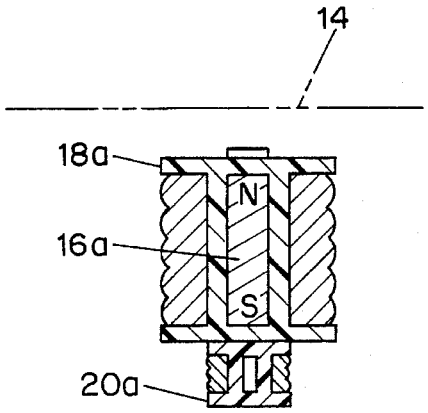
FIG. 3 is a cross-sectional view of the a pickup in accordance with an alternate embodiment of the invention.

FIG. 3 illustrates a cross-sectional view of an alternative embodiment of the present invention. In this embodiment, secondary bobbin 20*a* is disposed below primary bobbin 18*a*. Furthermore, permanent magnet 16*a* is positioned within primary bobbin 18*a* such that, preferably, the longitudinal edge portion constituting a magnetic north pole faces upward from the face of the instrument (not shown) and the opposing longitudinal edge portion constituting a magnetic south pole faces downward toward secondary bobbin 20*a*. More than one magnet may be positioned within primary bobbin 18, and pole pieces 8 may or may not be employed.

Figure 4:
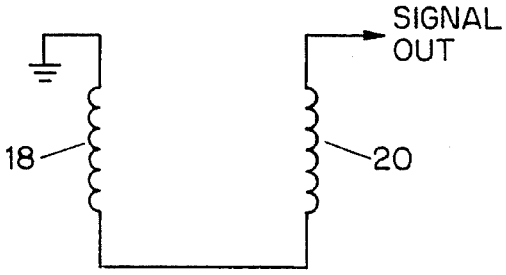
FIG. 4 is an electrical schematic diagram indicating the series mode of connection of the coils in the pickup.
Figure 5:
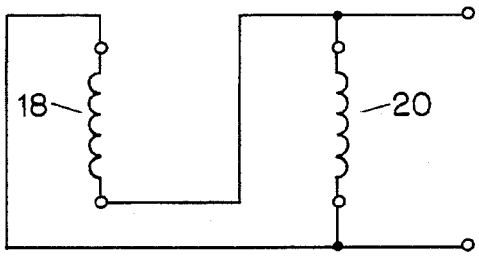
FIG. 5 is an electrical schematic diagram indicating the parallel mode of connection of the coils in the pickup.

Primary bobbin 18 and secondary bobbin 20 may be connected in series (as shown in FIG. 4) or connected in parallel (as shown in FIG. 5), depending on the design parameters of the specific pickup. Either configuration is designed so that 60 cycle signals sensed by coil 28 of primary bobbin 18 are cancelled by secondary bobbin 20.

Thus, in any embodiment of the present invention, permanent magnet 16 creates a magnetic field around coil 28 and pole piece 8 of primary bobbin 18. Preferably, no magnetic field is created around secondary bobbin 20. During playing, primary bobbin 18 senses changes in the magnetic field due to vibrations in strings 14 and converts the vibrations to electrical signals for amplification. Secondary bobbin 20 is employed solely to cancel any hum frequency caused by the instrument's power supply or another environmental source as described above in the background section. As the vibrating string area sensed by this pickup is considerably narrower (primary bobbin 18 only) than the string area sensed by the typical two bobbin pickup, the tone produced will be of a higher fidelity. This is due to the absence of reinforcement and phase cancellation typically created by two bobbins sensing a vibrating string 14 at different points along the string.

Finally, by employing a small secondary bobbin 20 as described above solely to cancel any hum, the resulting pickup 10 will have a lower resistance, impedance and inductance than that of a pickup .having two like bobbins. This allows for greater reproduction of higher frequencies with less degradation of tone.

Other modifications of the invention will occur to those skilled in the art and it is intended that the scope of the invention be limited only as set forth in the appended claims.

I claim:

1. An electromagnetic pickup device for a stringed musical instrument comprising:

a primary bobbin having an elongated body around which is wrapped a first coil of wire;

magnetic means for generating a magnetic field around said primary bobbin such that vibrations of said instrument's strings causes variations in said magnetic field which are sensed by said primary bobbin and converted into electrical signals for amplification; and a secondary bobbin having a body around which is wrapped a second coil of wire, said body being significantly smaller than said elongated body of said primary bobbin, said secondary bobbin positioned in close proximity to said primary bobbin to cancel an audible hum caused by frequencies radiating from surrounding electromagnetic generating sources.

2. The electromagnetic pickup of claim 1 wherein said magnetic means includes at least one permanent magnet having a first edge and a second edge of opposite polarities, said magnet positioned in close proximity to said primary bobbin to create said magnetic field therearound.

3. The electromagnetic pickup of claim 2 wherein said secondary bobbin is structured and positioned solely to cancel said audible hum.

4. The electromagnetic pickup of claim 3 wherein said elongated body of said primary bobbin further comprises one or more holes therethrough and wherein said magnetic means further comprises a plurality of pole pieces extended through said holes, said pole pieces having a first end adjacent to said permanent magnet and a second end adjacent to said instrument's strings.

5. The electromagnetic pickup of claim 4 wherein said secondary bobbin is adjacent to and in the same parallel plane as said primary bobbin.

6. The electromagnetic pickup of claim 5 wherein said secondary bobbin further comprises a ferromagnetic core.

7. The electromagnetic pickup of claim 6 wherein said first edge of said magnet constitutes a magnetic north pole and said second edge of said magnet constitutes a magnetic south pole.

8. The electromagnetic pickup of claim 3 wherein said at least one magnet is positioned within said primary bobbin.

9. The electromagnetic pickup of claim 8 wherein said secondary bobbin is positioned below said primary bobbin.

* * * * *